US008387433B2

(12) United States Patent
Berghs et al.

(10) Patent No.: US 8,387,433 B2
(45) Date of Patent: Mar. 5, 2013

(54) METHOD FOR APPLYING A COOLANT

(75) Inventors: Andreas Berghs, Neunkirchen (DE); Robert Simbeck, Kalchreuth (DE)

(73) Assignees: Siemens Aktiengesellschaft, München (DE); SMS Siemag Aktiengesellschaft, Düsseldorf (DE)

( * ) Notice: Subject to any disclaimer, the term of this patent is extended or adjusted under 35 U.S.C. 154(b) by 1057 days.

(21) Appl. No.: 11/922,581

(22) PCT Filed: Jun. 21, 2006

(86) PCT No.: PCT/EP2006/063382

§ 371 (c)(1),
(2), (4) Date: Dec. 18, 2007

(87) PCT Pub. No.: WO2006/136570

PCT Pub. Date: Dec. 28, 2006

(65) Prior Publication Data

US 2009/0084153 A1 Apr. 2, 2009

(30) Foreign Application Priority Data

Jun. 24, 2005 (DE) ..... 10 2005 029 461

(51) Int. Cl.
*B21B 27/10* (2006.01)
*B21B 37/74* (2006.01)

(52) U.S. Cl. ..... 72/201; 72/10.2; 72/236

(58) Field of Classification Search ..... 72/41, 43, 72/44, 9.1, 11.7, 201, 236, 365.2, 10.2
See application file for complete search history.

(56) References Cited

U.S. PATENT DOCUMENTS

| | | | | |
|---|---|---|---|---|
| 3,150,548 | A | 9/1964 | Roberts | |
| 3,802,237 | A | 4/1974 | Albensi et al. | |
| 4,392,367 | A | 7/1983 | Bald | |
| 4,612,788 | A * | 9/1986 | Kitagawa | 72/11.3 |

FOREIGN PATENT DOCUMENTS

| | | | |
|---|---|---|---|
| DE | 27 43 130 | A1 | 6/1978 |
| DE | 29 27 769 | A1 | 2/1981 |
| DE | 198 46 900 | C2 | 4/2000 |
| EP | 0 222 041 | B1 | 2/1991 |
| EP | 0 908 248 | A | 4/1999 |
| JP | 02 197309 | | 8/1990 |
| RU | 2208488 | C2 | 7/2000 |
| SU | 1296248 | A1 | 3/1987 |

OTHER PUBLICATIONS

Funktionsbeschreibung der Emulsions-Spritzeinrichtung für eine 5-gerüstige Kalttandemstraße bei einem Projekt "WISCO"; pp. 1-6.

* cited by examiner

*Primary Examiner* — Debra Sullivan

(57) ABSTRACT

There is described a method for applying a coolant to a rolled product and/or to at least one cylinder of a roll stand provided with a rolling gap. During the method the following steps can occur: determining a total cooling rate applicable according to the effective power in the rolling gap, determining the cooling rate for several areas according to a flatness distribution determined b a flatness measuring system, wherein the difference in the cooling rate is determined by comparing the totality of the thus determined cooling rates with a predetermined total cooling rate and is used for determining the components of an additional cooling rate for the areas taking into account the top and lower limits of the cooling rate thereof. Said procedure is repeated in such a way that the coolant differences remain above a predefinable value.

9 Claims, 3 Drawing Sheets

METHOD FOR APPLYING A COOLANT

CROSS REFERENCE TO RELATED APPLICATIONS

This application is the US National Stage of International Application No. PCT/EP2006/063382, filed Jun. 21, 2006 and claims the benefit thereof. The International Application claims the benefits of German application No. 10 2005 029 461.8 DE filed Jun. 24, 2005, both of the applications are incorporated by reference herein in their entirety.

FIELD OF INVENTION

The invention relates to a method for applying a coolant to a rolled product and/or to at least one working roll of a roll stand having a roll gap, wherein the rolled product is rolled with the aid of the roll stand. The invention also relates to a roll stand.

BACKGROUND OF INVENTION

The utilization of coolants or lubricants when rolling rolled products is described, for example, in "Grundlagen des Bandwalzens" ("*Basic principles of strip rolling*"), Karlheinz Weber, VEB Deutscher Verlag für Grundstoffindustrie, Leipzig, 1973, pages 210 to 215. In particular, the aforementioned document reference describes the utilization of oils or oil emulsions which are applied to a rolled product or to the rolls of a roll stand of a cold-rolling mill train.

The application of coolants, usually oil or oil emulsion, serves to cool the rolled product and/or the rolls of a roll stand. The roll gap of the roll stand is also lubricated by oil or oil emulsion at the same time. Therefore the coolant can also, or in an extreme case exclusively, serve as a lubricant.

SUMMARY OF INVENTION

The invention addresses a problem of applying a coolant to a rolled product and/or to at least one working roll of a roll stand in such a way that maximally constant and stable cooling and/or lubricating conditions are guaranteed.

This problem is solved by a method for applying a coolant to a rolled product and/or to at least one working roll of a roll stand having a roll gap, wherein the rolled product is rolled with the aid of the roll stand, and wherein the quantity of the coolant which must be applied is determined as a function of the effective power in the roll gap. In this way it is possible to minimize detrimental thickness influences and to prevent excessive strip and roll temperatures.

Advantageously, the effective power in the roll gap of the roll stand can be specified from the power of the drive of the roll stand in conjunction with the tension in the exit side and/or the tension in the entry side of the roll stand.

The quantity of the coolant which must be applied can preferably be determined in proportion to the effective power in the roll gap.

The flatness of the rolled product can advantageously be determined over a plurality of zones in the widthwise direction, wherein the coolant is applied in a distributed manner to the rolled product and/or to the at least one working roll as a function of the determined flatness distribution over the plurality of zones.

The method can beneficially be carried out using the following steps:

i) specify a total cooling quantity which must be applied as a function of the effective power in the roll gap;

ii) specify cooling quantities for a plurality of zones, these being arranged over the widthwise direction, as a function of a control deviation of the flatness distribution;

iii) determine a cooling quantity difference by comparing the sum of the cooling quantities as per step ii) with the total cooling quantity as per step i);

iv) determine additional cooling quantity portions for the zones on the basis of the cooling quantity difference as per step iii), subject to upper and lower limits of the cooling quantities for the zones;

v) repeat steps ii) to iv) until the cooling quantity difference as per step iii) falls below a predeterminable value.

The coolant can advantageously be applied to the rolled product with the aid of cooling nozzles.

BRIEF DESCRIPTION OF THE DRAWINGS

Further advantages and details of the invention are explained below by way of example with reference to the drawings, in which.

DETAILED DESCRIPTION OF INVENTION

Figure 1:
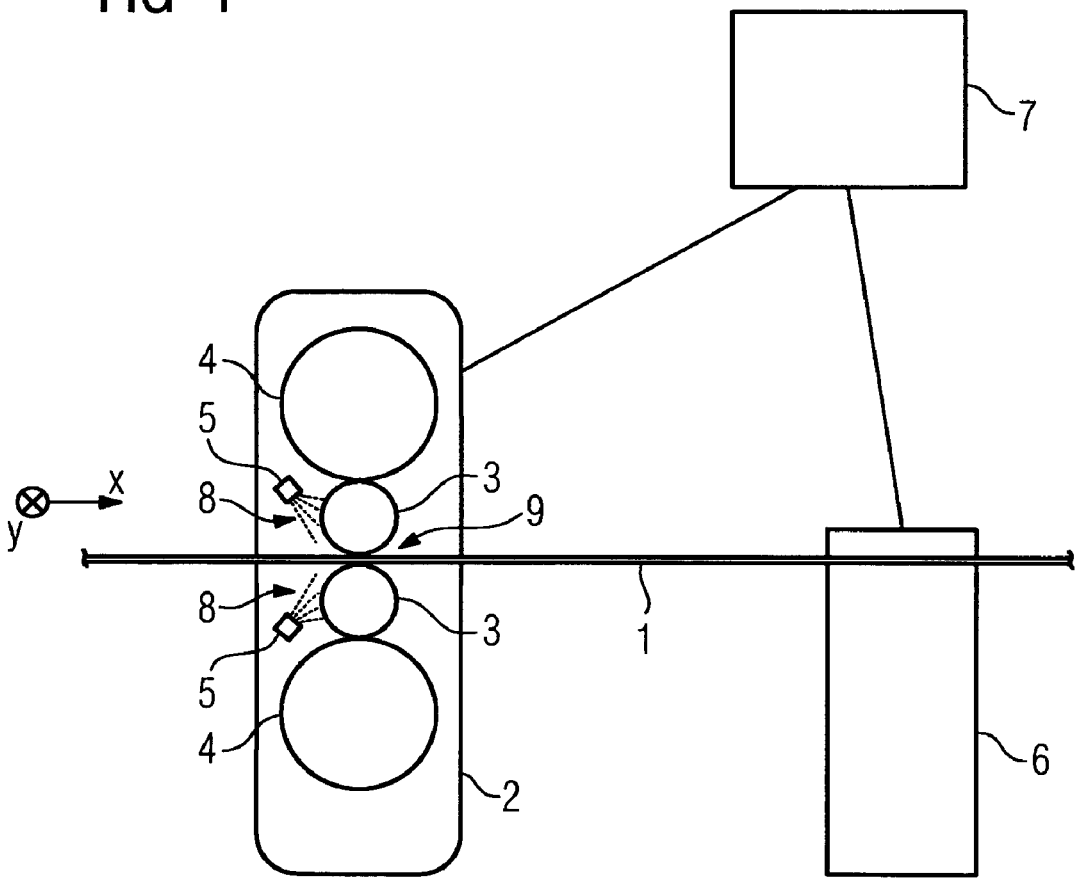
FIG. 1 shows a roll stand including a flatness measuring system and a control processor.

FIG. 1 shows a roll stand 2 including working rolls 3 and support rolls 4 for rolling a rolled product 1. The rolled product 1 is preferably embodied in strip form, having the form of a metal strip such as steel strip or light-metal strip, e.g. aluminum. In the example shown, the rolled product 1 passes through the roll stand 2 in a lengthwise direction x. The roll stand 2 has a plurality of working rolls 3 which extend in a widthwise direction y and are essentially arranged one above the other. The roll gap 9 through which the rolled product 1 passes during the rolling operation is located between the working rolls 3. Cooling nozzles 5 are arranged in a widthwise direction y and are oriented toward one or more of the working rolls 3 and/or the rolled product 1. The cooling nozzles 5 are used for applying coolant 8 to the rolled product 1 and/or the working rolls 3. In the case of cold rolling in particular, the rolls 3, 4 and the rolled product 1 can be cooled using so-called rolling oil as a coolant 8. In this case the rolling oil serves to lubricate the roll gap 9 at the same time. The coolant 8 can include an oil emulsion. The coolant 8 can consist at least partly of water.

Energy is supplied to the roll stand 2, and to the rolled product 1 which is located therein, by means of at least one drive which is not illustrated in further detail in the drawing. A large part of this energy is dissipated with the moving heated rolled product 1 and via the coolant 8, in particular the rolling oil. The division of the dissipated energy between the rolled product 1 and the coolant 8 is dependent on various factors, e.g. the type of the material to be rolled, material hardness, deformation resistance, and speed of the rolled product 1.

Figure 2:
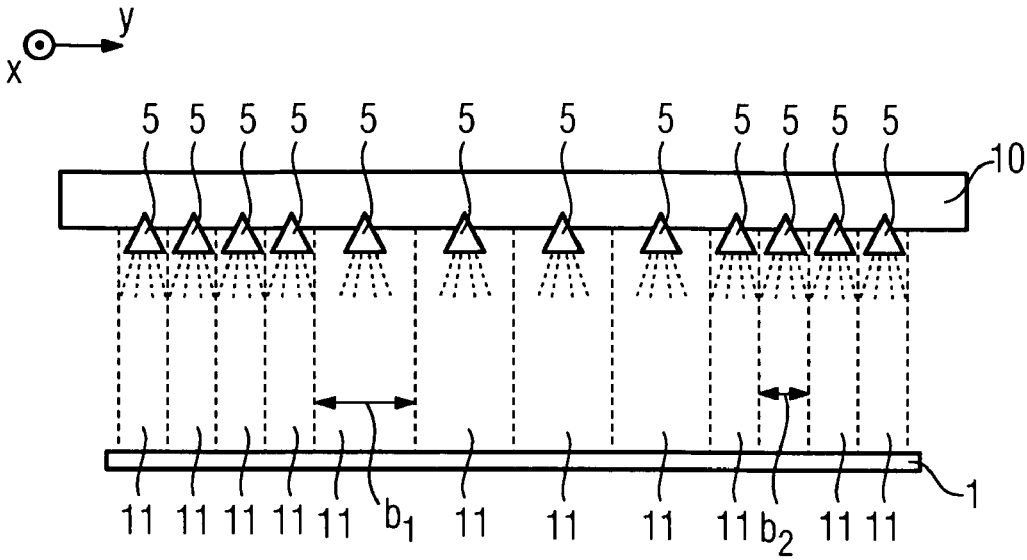
FIG. 2 shows an example of a cooling system having a plurality of zones which are arranged in a widthwise direction.

The cooling nozzles 5 are preferably arranged on one or more bars 10 (see FIG. 2—not shown in further detail in FIG. 1).

One to three bars 10 for cooling, and possibly additionally one further bar 10 for lubricating, are preferably provided per working roll 3 in a roll stand 2.

A flatness measuring system 6 which is linked to the roll stand 2 via a control processor 7 is arranged downstream of the roll stand 2, i.e. on the exit side of the roll stand 2, in the direction of movement of the rolled product 1, i.e. in lengthwise direction x in the example shown.

FIG. 2 shows a bar 10, this being arranged above the rolled product 1, of a cooling system for cooling the rolled product 1 and/or the rolls 3, 4. A sectional view of the rolled product is shown in the drawing. A plurality of cooling nozzles 5 are arranged on the bar 10 and are oriented at least partly toward the rolled product 1 and/or a working roll 3 which is not illustrated in further detail in FIG. 2. The cooling nozzles 5 are assigned to zones 11 in each case, wherein said zones 11 can have different widths $b_1$ or $b_2$. In the example shown in FIG. 2, small cooling zones having a width $b_2$ and large cooling zones having a width $b_1$ are illustrated, the width $b_1$ being twice as large as the width $b_2$. In the example shown in FIG. 2, exactly one cooling nozzle 5 is provided per zone 11 on a bar 10. The arrangement shown in FIG. 2 can easily be reproduced in an inverted manner as a cooling system which comprises cooling nozzles 5 and at least one bar 10 and is arranged underneath the rolled product 1.

Figure 3:
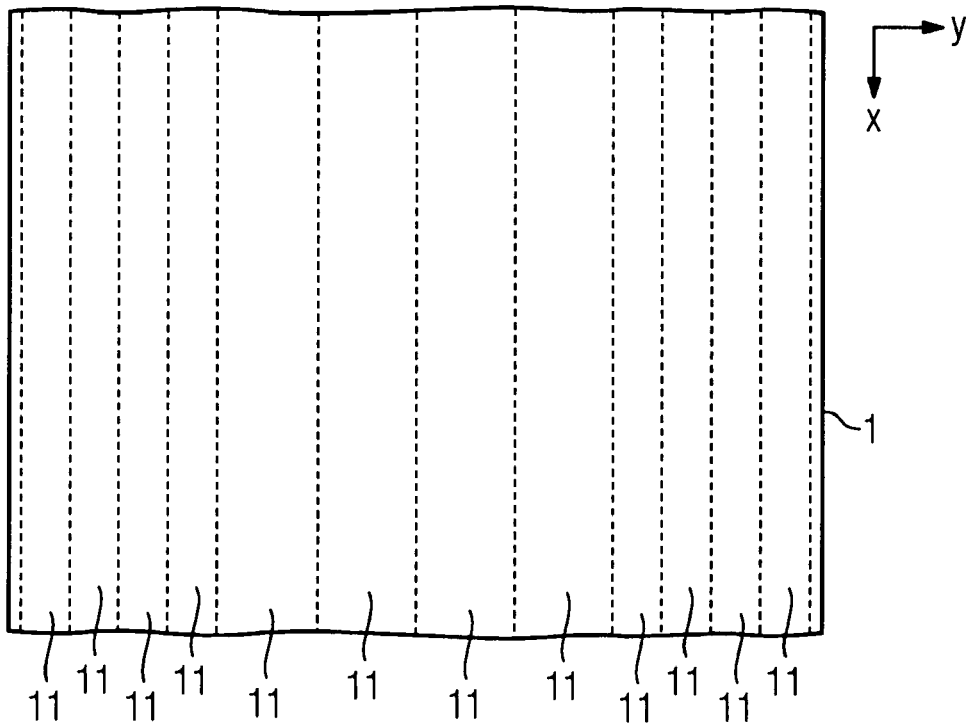
FIG. 3 shows an example of the arrangement of the zones with reference to the rolled product.

FIG. 3 shows the distribution of the zones 11 in relation to the rolled product 1. A plan view of the rolled product 1 is shown in the drawing.

In an exemplary embodiment of the invention, the total cooling quantity which is required for cooling in the roll stand 2 is determined as a function of the effective power in the roll gap 9. The total cooling quantity which is required can preferably be determined in proportion to the effective power in the roll gap 9. The effective power in the roll gap 9 is composed of the power of the at least one drive of the roll stand 2 plus the power in the exit-side tension of the roll stand 2 minus the power in the entry-side tension of the roll stand 2. The resulting power in the roll gap 9 is converted into deformation work and thence into heat.

The effective power in the roll gap 9 is determined in the rotational-speed adjustments of the drives which act on the rolled product 1 that is to be rolled. In general, the drives of a plurality of roll stands 2 act on the rolled product 1 which passes through a mill train.

The total cooling quantity is preferably limited to a minimum value in the case of low rolling speeds. Likewise, the total cooling quantity is advantageously limited to a maximum value in the case of high rolling speeds.

As indicated in the FIGS. 1 and 2, the required cooling quantity is applied via cooling nozzles 5 in the form of coolant 8 to the rolls 3, 4 (preferably the working rolls 3) and optionally to the rolled product 1. Cooling nozzles 5 are assigned to zones 11 in each case, with at least one (preferably exactly one) cooling nozzle 5 being provided for each zone 11.

In order to precisely set the total cooling quantity, the latter being determined as a function of the effective power in the roll gap 9, a total quantity regulator is superimposed on the multizone cooling adjustment and ensures that the required total cooling quantity is set by increasing or decreasing the cooling quantity in the individual zones 11 of the cooling. This ensures that the required total cooling quantity is kept as constant as possible under constant conditions. In this way, overheating of the rolled product 1 and the rolls 3, 4 (in particular the working rolls 3) is prevented. The setting of the cooling quantity for each individual zone 11 of the cooling takes place by specifying the on/off time ratio of the cooling valve of the corresponding cooling nozzle 5 or by means of a proportional valve.

Figure 4:
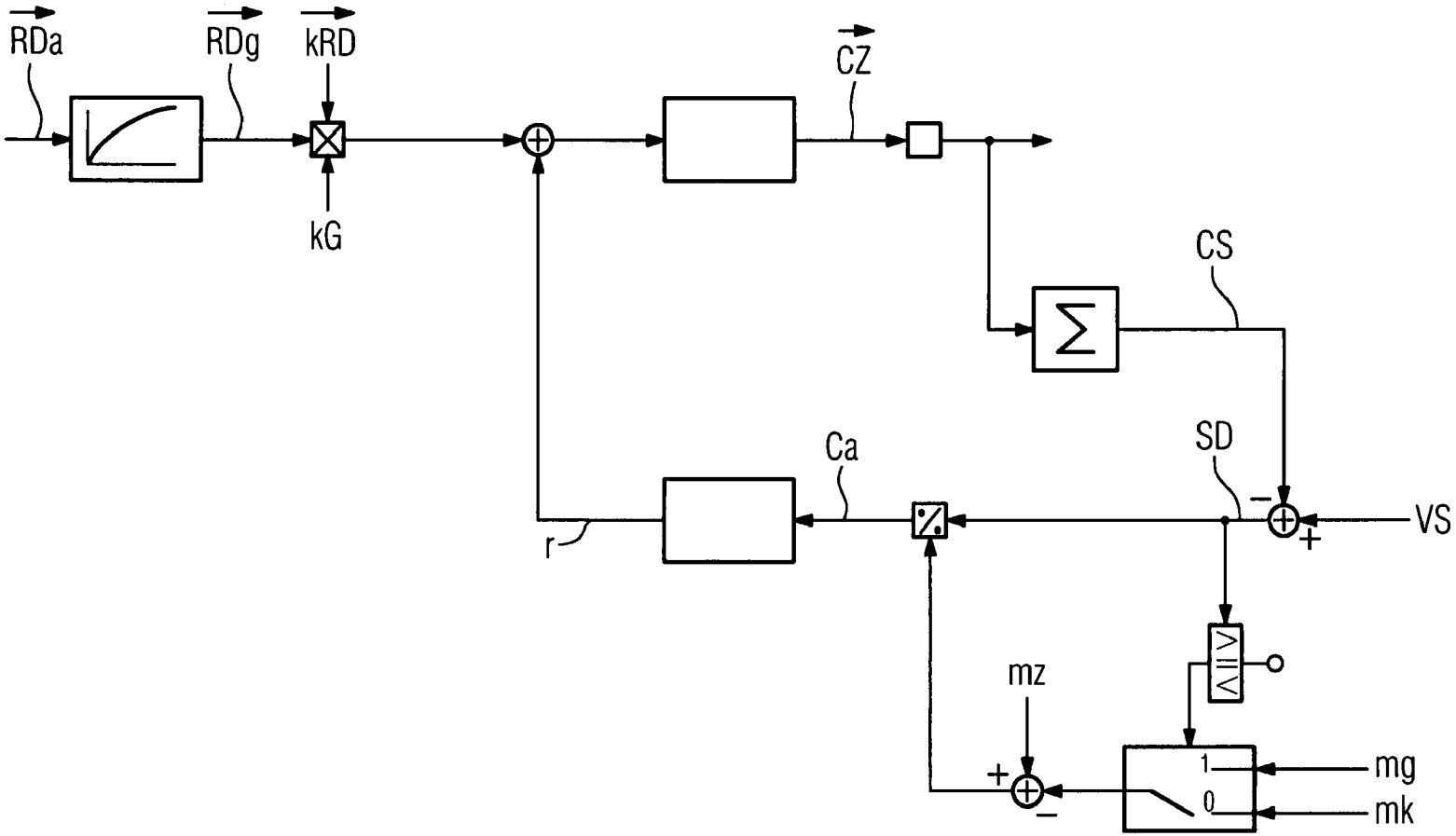
FIG. 4 schematically shows the execution of the method for specifying the cooling quantities for the individual zones.

As shown schematically in FIG. 4, a smoothed control deviation $R\vec{D}g$ per zone 11 is firstly formed from the current control deviation $R\vec{D}a$ per zone 11, and is multiplied in each case by a control-deviation-dependent amplification $k\vec{R}D$ and a zone-independent total control amplification kG. In this way, on the basis of the current control deviation $R\vec{D}a$ of the flatness distribution which is determined with the aid of the flatness measuring system 6 (see FIG. 1), a corresponding cooling quantity distribution $\vec{CZ}$ in the individual cooling nozzles 5 or zones 11 is determined by the multizone cooling adjustment. The current control deviation $R\vec{D}a$, smoothed control deviation $R\vec{D}g$, control-deviation-dependent amplification $k\vec{R}D$ and cooling quantity distribution $\vec{CZ}$ variables are vectors, wherein the number of elements in these vectors preferably corresponds to the number of zones 11. The remaining variables shown in FIG. 4 are preferably scalar.

The superimposed total quantity regulator compares the total cooling quantity CS, which derives from the flatness measurement or from the flatness adjustment, with the predetermined total cooling quantity VS. The predetermined total cooling quantity VS is preferably determined as a function of the effective power in the roll gap as described above by way of example. On the basis of the resulting total cooling quantity difference SD, an additional cooling quantity portion Ca is calculated for the individual cooling nozzles 5 or zones 11. It is taken into consideration here that a minimal or maximal cooling quantity per zone 11 cannot be exceeded and that different zone widths $b_1$, $b_2$ (see FIG. 2) require different coolant flow quantities. A distinction is made between insufficient cooling quantity portions mk relative to zones 11 of large width $b_1$ and excessive cooling quantity portions mg relative to zones 11 of large width $b_1$. The excessive cooling quantity portions mg relative to zones 11 of large width $b_1$ are subtracted from the total cooling quantity portions mz relative to zones 11 of large width $b_1$ in order to determine the additional cooling quantity portion Ca for the individual cooling nozzles 5. This additional cooling quantity portion Ca is not now added directly to the cooling quantity distribution $\vec{CZ}$, but is converted into a control deviation r and added thus to the regulator output of each zone 11. The comparison of the total cooling quantity CS with the predetermined total cooling quantity VS and the resulting correction of the regulator output is repeated until the difference between the total cooling quantity CS and the predetermined total cooling quantity VS falls below a predeterminable value.

The essence of the idea forming the basis of the invention can be summarized as follows:

The invention relates to a method for applying a coolant 8 to a rolled product 1 and/or to at least one roll 3, 4 of a roll stand 2 having a roll gap 9. In this case, a total cooling quantity which must be applied is initially specified as a function of the effective power in the roll gap 9. Cooling quantities for a plurality of zones 11 are then specified depending on the control deviation of the flatness distribution, said control deviation being determined by means of a flatness measuring system 6, wherein by comparing the sum of the cooling quantities thus determined with the previously specified total cooling quantity, a cooling quantity difference is determined, on the basis of which additional cooling quantity portions for the zones 11 are determined subject to upper and lower limits of the cooling quantities for the zones 11. This procedure is repeated until the cooling quantity difference falls below a predeterminable value. According to the invention, provision is made for constant and stable conditions of cooling and lubrication by adhering to the predetermined total cooling quantity VS. Thickness influences of the rolled product 1 and excessive temperatures of the rolled product 1 or the rolls 3, 4 are avoided.

The invention claimed is:

1. A method for applying a coolant to a material to be rolled using a roll stand, comprising:

providing a material and a roll stand;

rolling the material using the roll stand; and applying a coolant to the material during the rolling, wherein a quantity of the coolant applied to the material is based upon an effective power in a roll gap of the roll stand, wherein the effective power in the roll gap is determined by the power of at least one drive of the roll stand plus the power in an exit side of the roll stand minus the power in an entry side of the roll stand.

2. The method as claimed in claim 1, wherein the quantity of the applied coolant is proportional to the effective power in the roll gap.

3. The method as claimed in claim 1, wherein the quantity of the applied coolant is determined in parallel to the effective power in the roll gap.

4. The method as claimed in claim 1, wherein a flatness of the material is determined over a plurality of zones in a widthwise direction of the material, and wherein the coolant is applied in a distributed manner to the material.

5. The method as claimed in claim 1, wherein the coolant is applied to the material via a plurality of cooling nozzles, wherein each cooling nozzle is assigned to a zone.

6. The method as claimed in claim 1, wherein a control processor is linked to a flatness measuring system and to a cooling system determining the quantity of the coolant applied to the material.

7. The method as claimed in claim 6, wherein the cooling system has a plurality of cooling nozzles arranged on at least one bar.

8. A non-transitory computer readable medium comprising program code which, when executed on a control processor of, carries out a method for applying a coolant to a material, comprising:

determining a quantity of the coolant applied to the material based upon an effective power in a roll gap of a roll stand, wherein the effective power in the roll gap is determined by the power of at least one drive of the roll stand plus the power in an exit side of the roll stand minus the power in an entry side of the roll stand.

9. A roll stand, comprising:

a cooling system including a flatness measuring system and a control processor, wherein the control processor is linked to the flatness measuring system and the cooling system, a plurality of cooling nozzles which are arranged on at least one bar, wherein the control processor comprises program code, which, when executed on the control processor, carries out a method for applying a coolant to a material, wherein a quantity of the coolant applied to the material is based upon an effective power in a roll gap of the roll stand, wherein the effective power in the roll gap is determined by the power of at least one drive of the roll stand plus the power in an exit side of the roll stand minus the power in an entry side of the roll stand.

* * * * *

UNITED STATES PATENT AND TRADEMARK OFFICE

CERTIFICATE OF CORRECTION

PATENT NO. : 8,387,433 B2
APPLICATION NO. : 11/922581
DATED : March 5, 2013
INVENTOR(S) : Andreas Berghs et al.

It is certified that error appears in the above-identified patent and that said Letters Patent is hereby corrected as shown below:

In the Claims:

Col. 5, line 10, please remove: [to be rolled].

Signed and Sealed this
Sixth Day of August, 2013

Teresa Stanek Rea
*Acting Director of the United States Patent and Trademark Office*